United States Patent [19]

Sugasawa et al.

[11] 4,368,700

[45] Jan. 18, 1983

[54] SPLIT TYPE INTERNAL COMBUSTION ENGINE

[75] Inventors: Fukashi Sugasawa, Yokohama; Haruhiko Iizuka, Yokosuka, both of Japan

[73] Assignee: Nissan Motor Company, Limited, Kanagawa, Japan

[21] Appl. No.: 223,158

[22] Filed: Jan. 7, 1981

[30] Foreign Application Priority Data

Jan. 10, 1980 [JP] Japan ..... 55-1648

[51] Int. Cl.[3] ..... F02D 17/02

[52] U.S. Cl. ..... 123/198 F; 123/481; 123/568

[58] Field of Search ..... 123/198 F, 481, 568

[56] References Cited

U.S. PATENT DOCUMENTS

| | | | |
|---|---|---|---|
| 4,201,180 | 5/1980 | Fizuka | 123/198 F |
| 4,292,938 | 10/1981 | Tanaka et al. | 123/568 |
| 4,313,406 | 2/1982 | Fizuka et al. | 123/198 F |
| 4,320,726 | 3/1982 | Etoh et al. | 123/198 F |
| 4,337,740 | 7/1982 | Sugasawa et al. | 123/198 F |

FOREIGN PATENT DOCUMENTS 3018525 11/1980 Fed. Rep. of Germany .

397824 10/1932 United Kingdom .

OTHER PUBLICATIONS

Automotive Engineering, 3/1979, pp. 100–101.

7th Status Seminar, "Kraftfahrzeug und Strassenverkehr", Bad Durrheim 1979, paper by Hartig et al., BMW Sylinderabschaltung . . . .

*Primary Examiner*—Ira S. Lazarus

*Attorney, Agent, or Firm*—Schwartz, Jeffery, Schwaab, Mack, Blumenthal & Koch

[57] ABSTRACT

An internal combustion engine is disclosed which comprises first and second cylinder units each including at least one cylinder, a stop valve provided between the first and second cylinder units, an EGR passage for recirculating exhaust gases into the second cylinder unit, an EGR valve provided in the EGR passage, and control means for disabling the second cylinder unit when the engine load is below a given value. Means is provided to ensure that the EGR Valve opens after the stop valve closes when the engine load changes from its high condition to a low condition and to ensure that the stop valve opens just after the EGR valve closes when the engine load changes from its low condition to a high condition.

4 Claims, 7 Drawing Figures

SPLIT TYPE INTERNAL COMBUSTION ENGINE

BACKGROUND OF THE INVENTION

1. Field of the Invention

This invention relates to improvements in an internal combustion engine of the split type operable on less than all of its cylinders when the engine load is below a given value.

2. Description of the Prior Art

It is known and desirable to increase the efficiency of a multicylinder internal combustion engine by reducing the number of cylinders on which the engine operates under predetermined engine operating conditions, particularly conditions of low engine load. For this purpose, control means has been provided which disables a number of cylinders in a multicylinder internal combustion engine by suppressing the supply of fuel to certain cylinders or by preventing the operation of the intake and exhaust valves of selected cylinders. Under given load conditions, the disablement of some of the cylinders of the engine increases the load on those remaining in operation and, as a result, the energy conversion efficiency is increased.

It is common practice to introduce exhaust gases into the disabled cylinders through an EGR valve adapted to open under given low load conditions and to prevent the introduced exhaust gases from flowing to the cylinders remaining in operation by the use of a stop valve adapted to close in timed relation with the opening of the EGR valve. This is effective to suppress pumping loss in the disabled cylinders and attain higher fuel economy.

With such split type internal combustion engines, the stop valve should close before the EGR valve opens when the engine operation is shifted from its full engine mode where the engine operates on all of the cylinders into its split engine mode where the engine operates on less than all of the cylinders and also should open after the EGR valve closes when the engine operation is shifted from its split engine mode into its full engine mode. In order to attain high acceleration performance, the time delay of the opening of the stop valve with respect to the closure of the EGR valve must be relatively small. However, a small time delay results in a small time delay of the opening of the EGR valve with respect to the closure of the stop valve when the engine operation is shifted from its full engine mode into its split engine mode. This leads to the tendency of the stop valve to remains open after the EGR valve opens for some reasons to be described later so that exhaust gases escape through the stop valve, causing unstable engine operation when the engine operation is shifted from its full engine mode into its split engine mode.

The present invention provides an improved split type internal combustion engine where the stop valve can open in a very short time after the EGR valve closes so as to achieve high acceleration performance when the engine operation is shifted from its split engine mode into its full engine mode and also can close a relatively long time before the EGR valve opens so as to ensure that exhaust gases cannot escape through the stop valve.

SUMMARY OF THE INVENTION

The present invention provides an internal combustion engine which comprises first and second cylinder units each including at least one cylinder; an intake manifold divided into first and second intake passages leading to the first and second cylinder units, respectively, the second intake passage having therein a stop valve; an EGR passage for introducing exhaust gases into the second intake passage, the EGR passage having therein an EGR valve; and control means for providing a first control signal and disabling the second cylinder unit when the engine load is below a predetermined value, the control means providing a second control signal under high load conditions. The EGR Valve is driven by an EGR valve actuator which normally closes the EGR valve and opens it in response to a first drive signal. The stop valve is driven by a stop valve actuator which normally opens the stop valve and closes it in response to a second drive signal. Valve drive means is provided which is responsive to the first control signal for generating the second drive signal immediately and the first drive signal with a first delay predetermined to ensure that the EGR valve opens after the stop valve closes. This is effective to prevent exhaust gases from escaping through the stop valve into the first cylinder unit when the engine operation is shifted from its full engine mode into its split engine mode. In addition, the valve drive means is responsive to the second control signal for stopping the first drive signal immediately and the second drive signal with a second delay predetermined to ensure that the stop valve opens just after the EGR valve closes. This is effective to achieve high engine acceleration performance when the engine operation is shifted from its split engine mode into its full engine mode.

In a preferred embodiment, the control means provides a high output under low load conditions and a low output under high load conditions. The valve drive means comprises a delay circuit having an input from the control means. The delay circuit provides a high output with the first delay with respect to the occurrence of the high input from the control means and a low output with the second delay with respect to the occurrence of the low input from the control circuit. The first drive signal occurs when at least one of the outputs from the control means and the delay circuit is high.

The delay circuit may comprises an integrating circuit having a first resistor and a capacitor for integrating the signal from the control means, and a series circuit of a diode and a second resistor for discharging the capacitor. In order to increase engine acceleration performance, the second resistor may be removed.

DESCRIPTION OF THE DRAWINGS

The present invention will be described in greater detail by reference to the following description taken in connection with the accompanying drawings, in which.

DESCRIPTION OF THE PREFERRED EMBODIMENT

Figure 1:
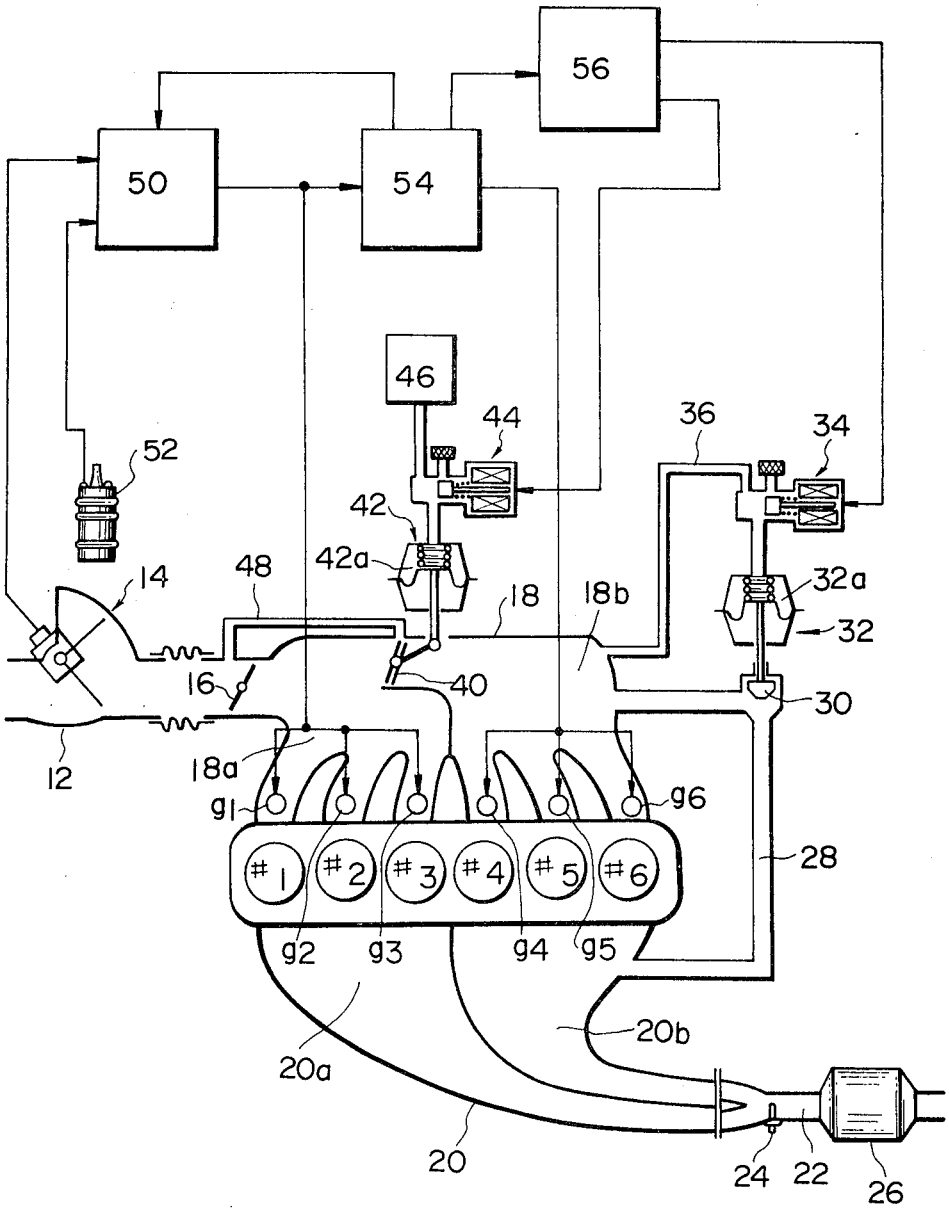
FIG. 1 (PRIOR ART)
FIG. 1 is a schematic sectional view showing a prior art split type internal combustion engine.

Prior to the description of the preferred embodiment of the present invention, we shall briefly describe the prior art split type internal combustion engine in FIG. 1 in order to specifically point out the difficulties attendant thereon.

Referring to FIG. 1, the reference numeral 10 designates an engine block containing therein an active cylinder unit including three cylinders #1 to #3 being always active and an inactive cylinder unit having three cylinders #4 to #6 being inactive when the engine load is below a predetermined value. Air is introduced to the engine through an air induction passage 12 provided therein with an airflow meter 14 and a throttle valve 16 drivingly connected to the accelerator pedal (not shown) for controlling the flow of air to the engine. The induction passage 12 is connected downstream of the throttle valve 16 to an intake manifold 18 which is divided into first and second intake passages 18*a* and 18*b*. The first intake passage 18*a* leads to the active cylinders #1 to #3, and the second intake passage 18*b* leads to the inactive cylinders #4 to #6.

The engine also has an exhaust manifold 20 which is divided into first and second exhaust passages 20*a* and 20*b* leading from the active cylinders #1 to #3 and the inactive cylinders #4 to #6, respectively. The exhaust manifold 20 is connected at its downstream end to an exhaust duct 22 which is provided therein with an exhaust gas sensor 24 and an exhaust gas purifier 26 located downstream of the exhaust gas sensor 24. The exhaust gas sensor may be in the form of an oxygen sensor which monitors the oxygen content in the exhaust and is effective to provide a signal indicative of the air/fuel ratio at which the engine is operating. The exhaust gas purifier 26 may be in the form of a three-way catalytic converter which effects oxidation of HC and CO and reduction of NOx so as to minimize the emission of pollutants through the exhaust duct 22.

An exhaust gas recirculation (EGR) passage 28 is provided which has its one end opening into the second exhaust passage 20*b* and the other end thereof opening into the second intake passage 18*b*. The EGR passage 28 has therein an EGR valve 30 which opens to permit recirculation of exhaust gases from the second exhaust passage 20*b* into the second intake passage 18*b* so as to minimize pumping losses in the inactive cylinders #4 to #6 during a split engine mode of operation. The EGR valve 30 closes to prevent exhaust gas recirculation during a full engine mode of operation.

The EGR valve 30 is driven by a first pneumatic valve actuator 32 which includes a diaphragm spreaded within a casing to define therewith two chambers on the opposite sides of the diaphragm, and an operating rod having its one end centrally fixed to the diaphragm and the other end thereof drivingly connected to the EGR Valve 30. The working chamber 32*a* is connected to the outlet of a first three-way solenoid valve 34 which has an atmosphere inlet communicated with atmospheric air and a vacuum inlet connected through a conduit 36 to the second intake passage 18*b*. The first solenoid valve 34 is normally in a position providing communication between the first valve actuator working chamber 32*a* and atmospheric air so as to close the EGR valve 30. During a split engine mode of operation, the first solenoid valve 34 is moved to another position where communication is established between the first valve actuator working chamber 32*a* and the second intake passage 18*b*, thereby opening the EGR valve 30.

The second intake passage 18*b* is provided at its entrance with a stop valve 40 normally opens to permit the flow of fresh air through the second intake passage 18*b* into the inactive cylinders #4 to #6. The stop valve 40 closes to block the flow of fresh air to the inactive cylinders #4 to #6 during a split engine mode of operation. The stop valve 40 may be in the form of a double-faced butterfly valve having a pair of valve plates facing in spaced-parallel relation to each other. A conduit 48 is provided which has its one end opening into the induction passage 12 somewhere upstream of the throttle valve 16 and the other end thereof opening into the second intake passage 18*b*, the other end thereof being in registry with the space defined by the valve plates when the stop valve 40 is in its closed position. Air, which is substantially at atmospheric pressure, is introduced through the conduit 48 into the space between the valve plates so as to ensure that the exhaust gases charged in the second intake passage 18*b* cannot escape into the first intake passage 18*a* when the stop valve 40 closes.

The stop valve 40 is driven by a second pneumatic valve actuator 42 which is substantially similar to the first valve actuator 32. The working chamber 42*a* of the second valve actuator 42 is connected to the outlet of a second three-way solenoid valve 44. The solenoid valve 44 has an atmosphere inlet communicated with atmospheric air and a vacuum inlet connected to a vacuum tank 46. The vacuum tank 46 may be connected through a check valve to the induction passage 12 somewhere downstream of the throttle valve 16 so that the vacuum in the vacuum tank 46 can be held at a level above the vacuum developed in the induction passage 12.

The second solenoid valve 44 is normally in a position providing communication between the second valve actuator working chamber 42*a* and atmospheric air so as to open the stop valve 40. When the engine operation is in a split engine mode, the second solenoid valve 44 is moved to another position where communication is established between the second valve actuator working chamber 42*a* and the vacuum tank 46 so as to close the stop valve 40.

The reference numeral 50 designates an injection control circuit which provides, in synchronism with engine speed such as represented by spark pulses from an ignition coil 52, a fuel-injection pulse signal A of pulse width proportional to the air flow rate sensed by the airflow meter 14 and corrected in accordance with an air/fuel ratio indicative signal from exhaust gas sensor 24. The fuel-injection pulse signal A is applied directly to fuel injection valves g1 to g3 for supplying fuel to the respective cylinders #1 to #3 and also through a split engine control circuit 54 to fuel injection valves g4 to g6 for supplying fuel to the respective cylinders #4 to #6. Each of the fuel injection valves g1 to g6 may be in the form of an ON-OFF type solenoid valve adapted to open for a period corresponding to the pulse width of the fuel-injection pulse signal A.

The split engine control circuit 54 determines the load at which the engine is operating from the pulse width of the fuel-injection pulse signal A and provides a split engine control signal which is at its high level when the engine load is below a given value and is at its low level under high load conditions. In addition, the split engine control circuit 54 permits the passage of the fuel-injection pulse signal A from the injection control circuit 50 to the fuel injection valves g4 to g6 at high load conditions and blocks the supply of the fuel-injection pulse signal A to the fuel injection valves g4 to g6 under low load conditions.

The split engine control signal is applied to a valve drive circuit 56. The valve drive circuit 56 is responsive to a low input from the split engine control circuit 54 to hold the first and second three-way solenoid valves 34 and 44 in their normal positions so as to close the EGR valve 30 and open the stop valve 40. When the valve drive circuit 56 receives a high input from the split engine control circuit 54, it changes the positions of the first and second three-way solenoid valves 34 and 44 so as to open the EGR valve 30 and close the stop valve 40.

Figure 2:
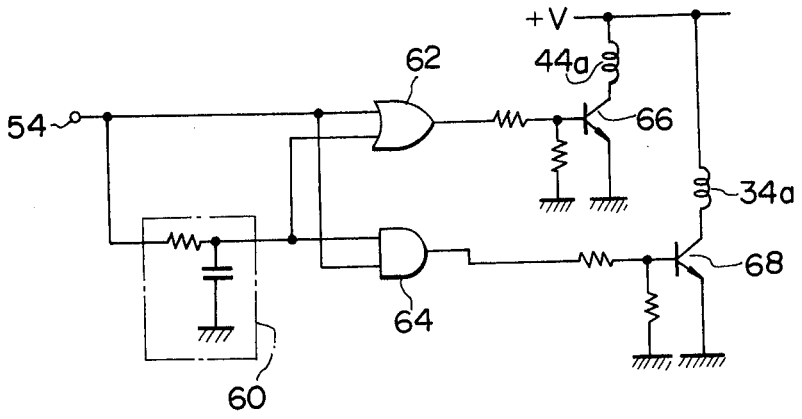
FIG. 2 (PRIOR ART)
FIG. 2 is a circuit diagram showing the detail structure of the valve drive circuit used in the engine of FIG. 1.

The valve drive circuit 56 will be described further with reference to FIG. 2. The split engine control signal is applied to one input of an OR circuit 62 and one input of an AND circuit 64. The split engine control signal is also applied through a delay circuit 60, shown as an integrating circuit, to the other input of the OR circuit 62 and also to the other input of the AND circuit 64. The output of the OR circuit 62 is connected through a resistor to the base of a transistor 66 which has its emitter grounded and its collector connected through the winding 44*a* of the second three-way solenoid valve 44 to a voltage source represented as +V. Similarly, the output of the AND circuit 64 is connected through a resistor to the base of transistor 68 which has its emitter grounded and its collector connected through the winding 34*a* of the first three-way solenoid valve 34 to the voltage source +V.

Figure 3:
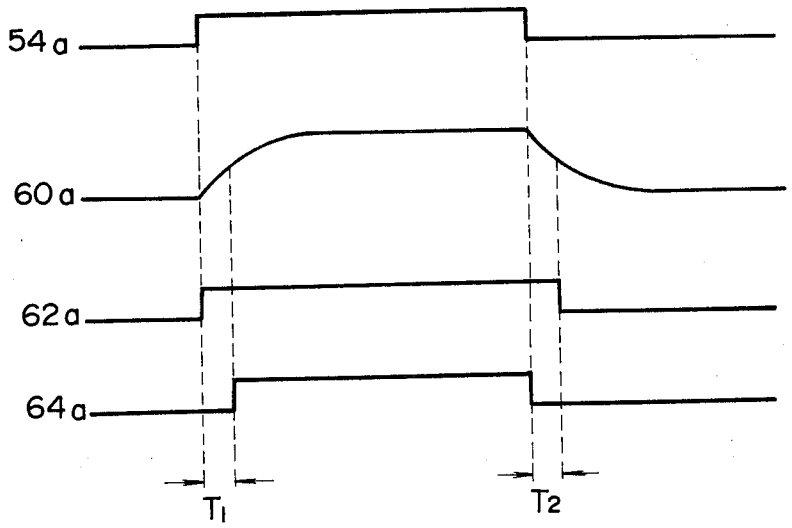
FIG. 3 (PRIOR ART)
FIG. 3 illustrates certain waveforms used in explaining the operation of the valve drive circuit of FIG. 2.

When the split engine control signal changes from its low level to its high level, as shown in waveform 54*a* of FIG. 3; that is, when the engine operation is changed from its full engine mode to its split engine mode, the output of the OR circuit 62 changes immediately to its high level, as shown in waveform 62*a* of FIG. 3, to conduct the transistor 66, thereby closing the stop valve 40. However, the output of the AND circuit 64 remains low, as shown in waveform 64*a* of FIG. 3, since the output of the delay circuit 60 is still below a level sufficient to change the output of the AND circuit 64, as shown in waveform 60*a* of FIG. 3. The output of the AND circuit 64 changes to its high level a time $T_1$ after the split engine control signal changes to its high level. When the AND circuit 64 provides a high output, the transistor 68 conducts to open the EGR valve 30. As a result, the EGR Valve 30 opens a time $T_1$ after the stop valve 40 closes without regard to the delay in the operation of the first and second valve actuators 32 and 42. In other wards, the time $T_1$ reresents the delay of the opening of the EGR valve 30 with respect to the closure of the stop valve 40 when the engine operation is shifted from its full engine mode into its split engine mode.

When the split engine control signal is changed from its high level to its low level, as shown in waveform 54*a* of FIG. 3; that is, when the engine operation is changed from its split engine mode to its full engine mode, the output of the AND circuit 64 immediately changes to its low level, as shown in waveform 64*a* of FIG. 3 to close the EGR Valve 30. On the other hand, the output of the OR circuit 62 remains high, as shown in waveform 62*a* of FIG. 3, since the output of the delay circuit 60 is still high, as shown in waveform 60*a* of FIG. 3. The output of the OR circuit 62 changes to its low level a time $T_2$ after the split engine control signal changes to its low level. When the OR circuit 62 provides a low output, the transistor 66 becomes non-conductive to open the stop valve 40. As a result, the stop valve 40 opens a time $T_2$ after the EGR valve 30 closes. That is, the time $T_2$ represents the delay of the opening of the stop valve 40 with respect to the closure of the EGR Valve 30 when the engine operation is shifted from its split engine mode into its full engine mode.

Figure 4:
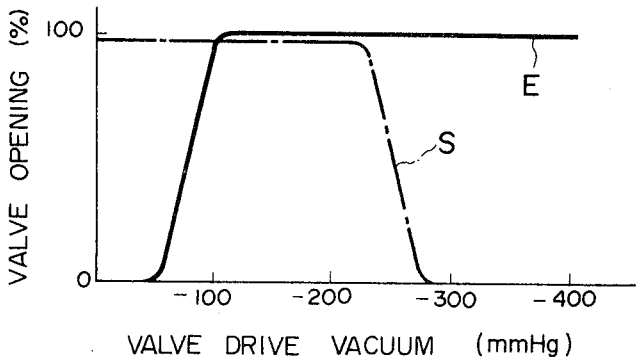
FIG. 4 is a graph showing normal characteristics of the EGR and stop valves.

With such a conventional split type internal combustion engine, it is common practice to drive the first and second valve actuators 32 and 42 by different vacuum sources. For example, as shown in FIG. 1, the first valve actuator 32 is driven by the vacuum developed in the second intake passage 18*b* and the second valve actuator 42 is driven by the vacuum stores in the vacuum tank 46. Thus, the first valve actuator 32 is designed to fully close the EGR valve 30 at about −50 mmHg and fully open it at about −100 mmHg, as shown by curve E of FIG. 4, whereas the second valve actuator 42 is designed to fully close the stop valve 40 at about −275 mmHg and fully open t at about −225 mmHg, as shown by curve S of FIG. 4.

It is desirable to increase engine acceleration performance by opening the stop valve 40 as soon as possible after the EGR Valve 30 closes when the engine operation is changed from its split engine mode into its full engine mode; i.e., by setting the time $T_2$ as short as possible. If the time $T_2$ is set at a small value with such a conventional valve drive circuit, however, the time $T_1$ will become short so that the EGR Valve 30 tends to open before the stop valve 40 closes in spite of the presence of the delay circuit 60 when the engine operation is shifted from its full engine mode to its split engine mode, since the EGR Valve 30 is driven by a vacuum rather smaller than the vacuum used for driving the stop valve 40 as can be seen from FIG. 4. This causes exhaust gases to escape through the stop valve 40 into the cylinders #1 to #3, resulting in unstable engine operation.

In accordance with the present invention, this dilemma can be overcome by providing an improved valve drive circuit where the times $T_1$ and $T_2$ can be set independently. This permits the stop valve 40 to open immediately after the EGR valve 30 closes when the engine operation is shifted from its split engine mode to its full engine mode and ensures that the EGR valve 30 opens after the stop valve 40 fully closes when the engine operation is shifted from its full engine mode to its split engine mode.

Figure 5:
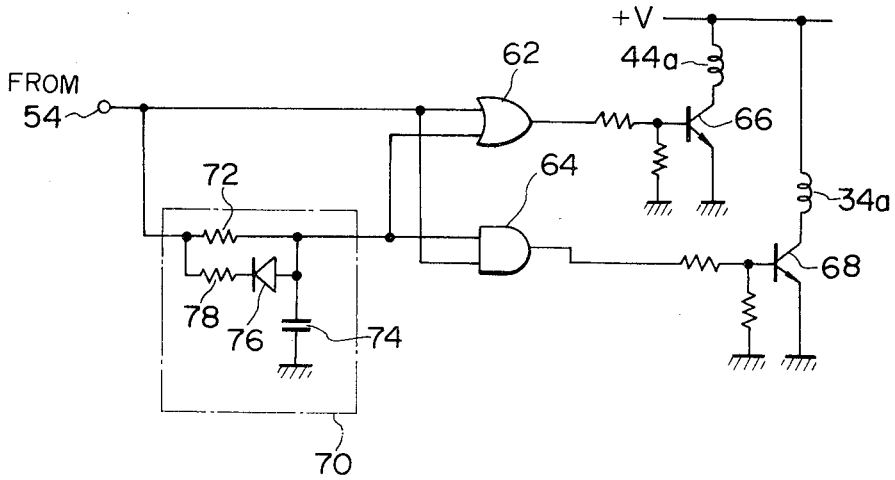
FIG. 5 is a circuit diagram showing a valve drive circuit made in accordance with the present invention.

Referring now to FIG. 5, there is illustrated a drive circuit made in accordance with the present invention. The structure shown in FIG. 5 is generally the same as shown in FIG. 2 except that the resistor 72, which constitutes an integrating circuit along with a capacitor 74, is connected in parallel with a series circuit of a diode 76 and a resistor 78. Accordingly, parts in FIG. 5 which are like those in FIG. 2 have been given the same reference character and will not be described further.

The capacitor 74 is charged through the resistor 72 and discharged through the diode 76, the resistor 78 and the resistor 72. The resistor 78 is selected to have a resistance difference between the time $T_1$ required for the output of the delay circuit 70 to increase from its low level to its high level and the time $T_2$ required for the delay circuit output to decrease from its high level to its low level, as shown in wave from 70*a* of FIG. 6.

The times $T_1$ and $T_2$ can independently be set by the choice of the resistors 72 and 78.

Figure 6:
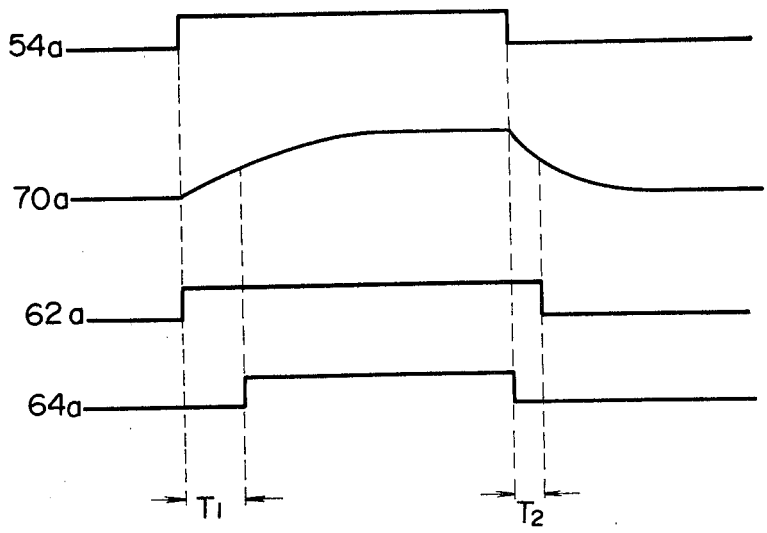
FIG. 6 illustrates certain waveforms used to explain the operation of the valve drive circuit of FIG. 5.

When the split engine control signal changes from its low level to its high level, as shown in waveform 54*a* of FIG. 6, the output of the OR circuit 62 changes immediately to its high level, as shown in waveform 62*a* of FIG. 6, to conduct the transistor 66, thereby closing the stop valve 40. While, the output of the AND circuit 64 remains low, as shown in waveform 64*a* of FIG. 3, since the output of the delay circuit 70 is still low, as shown in waveform 70*a* of FIG. 6. The output of the AND circuit 64 changes to its high level a time $T_1$ after the split engine control signal changes to its high level. That is, the EGR Valve 30 opens a time $T_1$ after the stop valve 40 closes, without regard to the delay in the operation of the first and second valve actuators 32 and 42, when the engine operation is shifted from its full engine mode into its split engine mode.

When the split engine control signal is changed from its high level to its low level, as shown in waveform 54*a* of FIG. 6, the output of the AND circuit 64 immediately changes to its low level, as shown in waveform 64*a* of FIG. 6 to close the EGR Valve 30. However, the output of the OR circuit 62 remains high, as shown in waveform 62*a* of FIG. 6 until a time $T_2$ lapses after the split engine control signal changes to its low level. When the OR circuit 62 provides a low output, the transistor 66 becomes non-conductive to open the stop valve 40. That is, the stop valve 40 opens a time $T_2$ after the EGR Valve 30 closes when the engine operation is shifted from tis split engine mode into its full engine mode.

Although the time $T_1$ is normally set at a value larger than the time $T_2$, there is no intention to be limited to such conditions. The times $T_1$ and $T_2$ may be set with regard to the delay determined by the kind of the vacuum source for driving the first and second valve actuators 32 and 42, the characteristics of the EGR and stop valves 30 and 40, and other conditions. By the choice of the resistors 72 and 78, the time $T_1$ can be set at a suitable value to ensure that the EGR Valve 30 opens after the stop valve 40 fully closes so as to prevent exhaust gases from escaping through the stop valve 40 into the cylinders #1 to #3 when the engine operation is shifted from its full engine mode to its plit engine mode and the time $T_2$ can be set at a suitable value to permit the stop valve 40 to open immdiately after the EGR Valve 30 closes so as to provide desirable engine acceleration performance when the engine operation is shifted from its split engine mode to its full engine mode.

Figure 7:
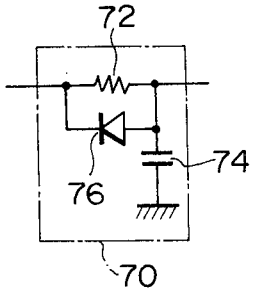
FIG. 7 is a circuit diagram showing a modification of the delay circuit used in the valve drive circuit of FIG. 5.

In case where engine acceleration performance is regard as major importance, the resistor 78 may be removed from the delay circuit 70, as shown in FIG. 7. This Arrangement permits the stop valve 40 to open in a time shorter than that required in the arrangement of FIG. 5 when the engine operation is shifted from its split engine mode into its full engine mode.

While the present invention has been described in connection with a six cylinder internal combustion engine, it is to be noted that the particular engine shown is only for illustrative purposes and the structure of this invention could be readily applied to any split engine structure. In addition, while the present invention has been described in connection with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) first and second cylinder units each including at least one cylinder;

(b) an intake manifold divided into first and second intake passages leading to said first and second cylinder units, respectively, said second intake passage having therein a stop valve;

(c) an EGR passage for introducing exhaust gases into said second intake passage, said EGR passage having therein an EGR Valve;

(d) control means for providing a first control signal and disabling said second cylinder unit when the engine load is below a predetermined value, said control means providing a second control signal under high load conditions;

(e) an EGR valve actuator for operating said EGR Valve, said EGR Valve actuator normally closing said EGR Valve and opening the same in response to a first drive signal;

(f) a stop valve actuator for operating said stop valve, said stop valve actuator normally opening said stop valve and closing the same in response to a second drive signal; and (g) valve drive means responsive to the first control signal for generating the second drive signal immediately and the first drive signal with a first delay predetermined to ensure that said EGR valve opens after said stop valve closed, said valve drive means responsive to the second control signal for stopping the first drive signal immediately and the second drive signal with a second delay predetermined to ensure that said stop valve opens just after said EGR Valve closes.

2. An internal combustion engine according to claim 1, wherein said control means provides a high output under low load conditions and a low output under high load conditions, and where said valve drive means comprises:

(a) a delay circuit having an input from said control means, said delay circuit providing a high output with the first delay with respect to the occurrence of the high input from said control means, said delay circuit providing a low output with the second delay with respect to the occurrence of the low input from said control means;

(b) means having inputs from said control means and said delay circuit, said means providing the first drive signal when both of its inputs are high; and (c) means having inputs from said control means and said delay circuit, said means providing the second drive signal when at least one of its inputs is high.

3. An internal combustion engine according to claim 2, wherein said delay circuit comprises an integrating circuit having a resistor and a capacitor for integrating the signal from said control means, and a series circuit of a diode and a resistor for discharging said capacitor.

4. An internal combustion engine according to claim 2, wherein said delay circuit comprises an integrating circuit having a resistor and a capacitor for integrating the signal from said control means, and a diode for discharging said capacitor.

* * * * *